United States Patent [19]

Giumenta et al.

[11] Patent Number: 4,732,078

[45] Date of Patent: Mar. 22, 1988

[54] CHIMNEY CAP

[76] Inventors: Frank Giumenta; Frederic Giumenta, both of 11 Thomas Rd., Rockville Centre, N.Y. 11570

[21] Appl. No.: 42,043

[22] Filed: Apr. 24, 1987

[51] Int. Cl.[4] ..... F23J 13/08

[52] U.S. Cl. ..... 98/67

[58] Field of Search ..... 98/67, 83, 86.5, 122

[56] References Cited

U.S. PATENT DOCUMENTS

| | | | |
|---|---|---|---|
| 2,976,796 | 3/1961 | Anthony et al. | 98/67 |
| 4,007,759 | 2/1977 | Martin et al. | 98/122 X |
| 4,436,021 | 3/1984 | Hisey | 98/67 |
| 4,549,473 | 10/1985 | Alexander et al. | 98/67 |

*Primary Examiner*—Harold Joyce

*Attorney, Agent, or Firm*—Philip Sands

[57] ABSTRACT

A chimney cap for protecting the upper open end of a chimney flue from the ingress of undesirable elements, such as squirrels, raccoons and birds or the like, is disclosed. The cap comprises a housing having four (4) perforated sides which are integral in succession with one another, the four sides being formed from a flat metal blank the longitudinal span of which is greater than the transverse span thereof, the blank including along one longitudinal edge thereof four (4) flanges integral with and extending transversely outwardly of the blank, the flanges being spaced in longitudinal succession from one another. The foregoing abstract is neither intended to define the invention disclosed, nor is it intended to be limiting as to the scope in any way.

7 Claims, 3 Drawing Figures

CHIMNEY CAP

BACKGROUND OF THE INVENTION

The invention relates generally to a chimney cap for protecting the upper open end of a chimney flue from the ingress of undesirable elements in the form of small animals such as squirrels, rodents, or raccoons and the like, as well as leaves from the overhanging tree limbs and the rain.

It is another object of the present invention to provide a chimney cap which does not interfere with the continuous movement of air through the fireplace and chimney and, thereby, present no obstacle to a continuous and forceful up-draft in the chimney flue.

It is still a further object of the present invention to provide a chimney cap for protecting chimney flues, and that can be installed simply, rapidly, and with a minimum amount of tools or the like.

It is still a further object of the present invention to provide a chimney cap that can be manufactured rapidly, inexpensively, and yet remain durable and reliable throughout its life on a chimney flue.

It is another object of the present invention to provide a chimney cap the four wall housing of which is manufactured in a single or one-piece element such as that which is formed from a flat metal blank presenting various flanges for being bent into an array for supporting the housing on a chimney flue.

Further objects and advantages of this invention will become apparent as the following description proceeds.

SUMMARY OF THE INVENTION

Briefly stated, and in accordance with the invention, there is provided a chimney cap for protecting the upper open end of a chimney flue from the ingress of certain undesirable elements.

In the preferred embodiment, the chimney cap includes a housing having four (4) perforated sides which are integral in succession with one another, the four (4) sides being formed from a flat metal blank the longitudinal span of which is greater than the transverse span thereof. The blank is formed such that along one longitudinal edge thereof there are presented four (4) flanges which are integral with an extend transversely outwardly of the blank. The flanges are spaced in longitudinal succession from one another.

The flanges provide the basis for supporting the chimney cap formed from the metal blank upon the chimney flue. Each of the flanges is bent into two (2) integral flange portions of identical transverse dimension, one (1) of the integral flange portions of each of the flanges which is most proximate to the longitudinal edge of the blank from which the flanges extend being bent back beyond said longitudinal edge and extending parallel to the plane of the blank. The other one of the integral flange portions of each of the flanges is bent to extend perpendicular to the plane of the blank.

The blank is bent into four (4) sides such that the opposite ends thereof close upon one another and form a loop of generally square or rectangular cross section complimenting the cross section of the chimney flue upon which the cap is to be seated. With the blank bent in such a four-sided condition, the flanges likewise are related to one another in a square or rectangular array and actually rest upon the top portion of the chimney flue. Mounted upon the four-sided housing is a roof, or the like, of similar metal composition and acts to prevent the ingress through the housing and into the chimney flue of various undesirable elements as aforementioned.

BRIEF DESCRIPTION OF THE DRAWINGS

Other objects and advantages of the invention will become apparent upon reading the following detailed description and upon reference to the drawings, in which.

Figure 1:
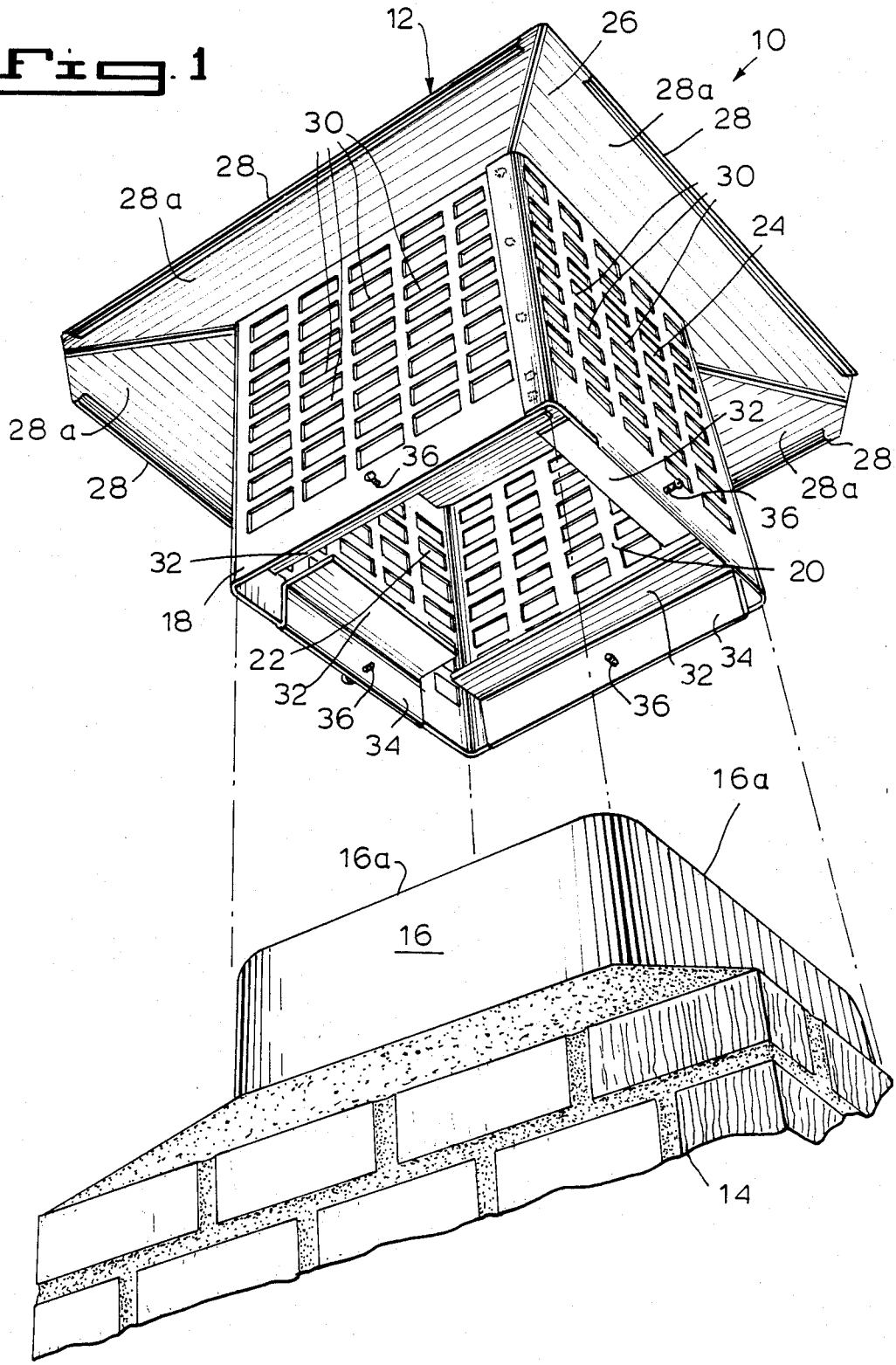
FIG. 1 is an exploded perspective view illustrating the present invention as it would be seated upon the upper exposed portion of a chimney flue, the chimney being illustrated as partially fragmented.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

With continued reference to the drawings, wherein like reference numerals have been used throughout to designate like elements, the present invention is designated generally by the reference character 10.

The invention 10 is in the form of a chimney cap generally denoted by the reference character 12. As illustrated in FIG. 1, the chimney cap 12 is adapted to be seated upon and protect a conventional brick chimney generally denoted by the reference character 14 having at the upper exposed end thereof a chimney liner denoted generally by the reference character 16.

The housing 12 is adapted to be seated upon the liner 16 of the chimney 14 and thereby protect the chimney flue from ingress of undesirable elements in the form of animal life, plant life, or rain and snow and the like.

The chimney cap 12 is formed with four perforated sides, the opposite or opposing sides being generally identical to one another both in shape and dimension. For example, the front perforated side 18 and the rear perforated side 20 are substantially identical to one another, whereas the two perforated sides 22 and 24 of the chimney cap 12 are generally identical to one another.

Particularly, the sides 18, 20, 22, and 24 may all be of identical dimension and contour thereby forming a square-like array. Alternatively, the sides 18 and 20 may both be either larger or smaller than the sides 22 and 24, thereby presenting a rectangular-like array. In either instance, however, the opening at the lower portion of the housing 12 must compliment the size and configuration of the opening 16 presented by the flue lining 16 of the chimney 14.

As is further illustrated in FIG. 1, the housing 12 is provided with a roof 26 which is affixed permanently to the four sides of the housing 12 and is preferably inclined from each of the free edges thereof (as denoted by reference characters 28, respectively) upwardly toward the center of the housing 12 to merge at a higher elevation. This will permit rain or other elements simply to slide vertically downwardly along the inclined portion of the roof and off the housing 12.

In the preferred embodiment, the roof 26 is constructed such that there is a small overhang extending beyond each of the sides 18, 20, 22 and 24 of the housing 12, and denoted generally by the reference characters 28*a*. The overhang of the roof 26 acts to insure that the elements roll off the roof and not into the housing or chimney flue 16.

It will also be understood that with respect to the preferred embodiment of the present invention each of the side walls 18, 20, 22 and 24 is provided with substantially the same type of perforations, which may be either oval, circular, rectangular or square, or otherwise. The perforations are denoted generally by the reference characters 30.

The bottom open portion of the housing 12 is provided with four flanges each denoted generally by the reference character 32. The flanges 32 extend in part perpendicular to the respective sides with which the flanges are integral, and thereby are designed to over-lie and rest upon the extreme upper edge 16*a* of the chimney flue 16.

Each of the perpendicular oriented flange portions 32 associated with the respective sides of the housing 12 is formed as part of a secondary flange portion 34 which is bent upwardly and inwardly of its respective side of the housing 12. The flange portions 32 which extend perpendicular to the plane of each of their associated sides of the housing 12 are oriented in such a condition because of the generally upwardly or inturned flange portions 34 which extend parallel to the planes of their respective sides of the housing 12.

By means of the flange portions 34 which extend upwardly and parallel to the planes of their respective sides of the housing 12, and the bent portions 32 of the flanges which extend generally perpendicular to their respective associated sides of the housing 12, the flange portions 32 present a shoulder for resting upon the upper most exposed portion 16*a* of the chimney flue 16. In turn, the sides 18, 20, 22 and 24 of the housing 12 act to surround, in close proximity, the vertical exterior of the chimney flue 16.

Figure 3:
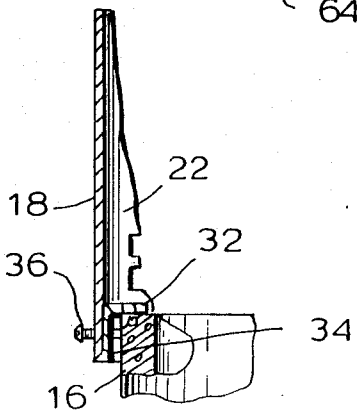
FIG. 3 is a fragmented, elevational view illustrating a portion of the present invention, partially in cross section, as seated upon the upper portion of a chimney flue, the flue being illustrated as fragmented, likewise.

In order to affix, releasably, the chimney cap 12 to the vertical exterior 16 of the chimney, at the lower portion of each of the sides 18, 20, 22 and 24, there are provided a threaded opening into which a threaded bolt, identified in each instance by the reference character 36, can be turned, for example, by means of a screwdriver, into tight engagement with the vertical exterior of the flue liner 16 (see FIG. 3).

As a consequence, the chimney cap 12 can be installed upon the chimney flue 16, in rather tight-fit, surrounding relation, by simply positioning the chimney cap 12 above the chimney 14 and upon the flue 16. The flange portions 32 extending perpendicular to each of the sides of the housing 12 will then act as an abutment or shoulder to maintain the housing 12 in an upright position upon the chimney flue 16. The threaded bolts 36 can then be turned into tight frictional engagement with the vertical side surfice of the chimney flue 16 and thereby maintain the chimney cap 12 of the present invention 10 in an operative position upon the chimney 14.

Figure 2:
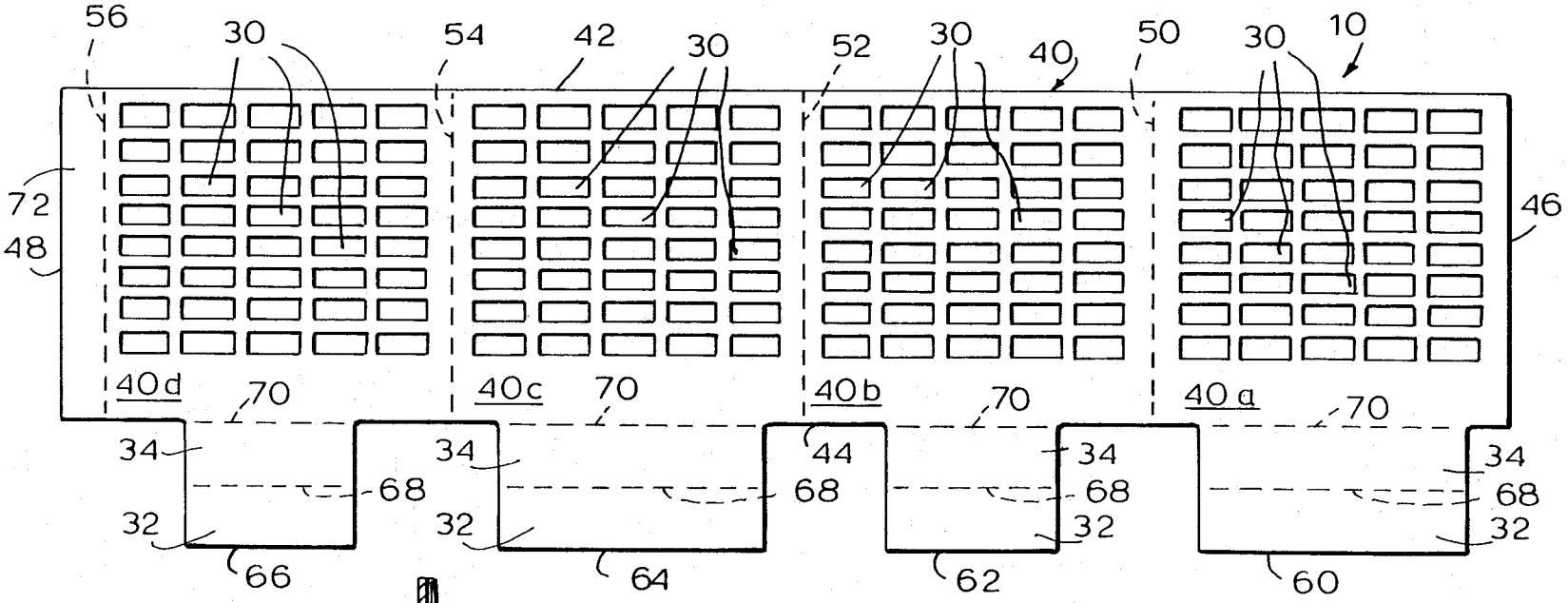
FIG. 2 is a plan view of the present invention in its preferred form.

Referring now to FIG. 2 of the drawings,it will be noted that the present invention 10 is derived from a flat, metal blank, preferably which is of rust-proof or rust-resistant composition, the blank being denoted generally by the reference character 40. As can be seen, the blank 40 is generally rectangular in configuration, and has two longitudinal edges, namely, edges 42 and 44, as well as two transverse and edges 46 and 48. In addition, the blank 40 is provided with four sets of perforations, namely, the perforation 30 as illustrated in FIG. 1. The four sets of perforations 40 are separated from one another, for reference purposes only, by the respective broken lines 50, 52, 54 and 56.

In addition, the blank 40 includes four flanges 60, 62, 64 and 66, respectively. For reference purposes again, the flanges 60, 62, 64 and 66 are each shown with a broken line 68 which acts to divide the flange portions 32 and 34 from one another with respect to each of the flanges 60, 62, 64 and 66.

In order to assemble the blank 40 into the four sided housing 12 as illustrated in FIG. 1, the blank 40 illustrated in FIG. 2 can be bent along the broken lines 50, 52, 54 and 56, as well as along the broken line 68 in each of the flanges 60, 62, 64 and 66. In this respect, each of the flanges 60, 62, 64 and 66 may be bent along the longitudinal edge 44 at the reference broken lines 70 such that first the entirety of the flanges 60, 62, 64 and 66 overlie the blank 40 in generally superposed relation, parallel to the plane of the blank 40. Thereafter, the flanges 60, 62, 64 and 66 are bent in such a manner that the flange portions 32 of each of the flanges extend perpendicular to the plane of the blank 40.

With the flanges bent in the manner aforementioned, the blank 40 can then be bent first along the reference broken line 50 such that the two extreme perforated portions of the blank 40 to the right of FIG. 2 (portions 40*a* and 40*b*) are perpendicular to one another. Similarly, the two extreme left perforated portions of the blank 40 (portions 40*c* and 40*d*) can then be bent along the broken reference lines 52 and 54 so that they too are in perpendicular relation to one another as well as perpendicular to the other pair of perforated portions (40*a* and 40*b*) of the blank 40 in FIG. 2.

In such a bent condition of the blank 40 illustrated in FIG. 2, the edge 46 at the extreme right end will abut against the broken reference line 56 at the extreme left end of the blank 40. At such time, the blank 40 can once again be bent, this time along the broken reference line 56 such that a flap portion 72 at the extreme left end of the blank 40 overlaps the free edge 46 of the blank 40.

Once in this condition, the blank 40 presents an either square or rectangular cross section such that either all of the perforated portions of the blank 40 are identical (thereby presenting a square configuration), or alternate ones of the perforated portions are of the same dimension (whereby the configuration in cross section of the folded or bent blank is that of a rectangular cross section). In either instance, the rectangular or square cross section of the bent blank 40 is provided to compliment the cross section of the flue liner 16 illustrated in FIG. 1 such that the chimney cap can be mounted upon the chimney flue 16.

It will be understood, that prior to assembling the foursided housing 12 upon the flue liner 16, it is necessary to permanently weld the roof 26 (illustrated in FIG. 1) to the upper portion of the four-sided housing 12 such as, for example, by spot welding, as well as weld the left-end flap 72 of the blank 40 to the edge portion 46 at the right end of the blank 40 illustrated in FIG. 2.

With the chimney cap assembled as described above, it can now be mounted upon the flue liner 16 of the chimney 14, in a manner as illustrated in FIG. 3 (which is self-explanatory), and as discussed above.

What is claimed is:

1. A chimney cap for protecting the upper open end of a chimney flue for ingress of undesirable elements, said cap comprising a housing having four perforated sides which are integral in succession with one another, said four sides being formed from a flat metal blank the longitudinal span of which is greater than the transverse span thereof, said blank including along one longitudinal edge thereof four flanges integral with an extending transversely outwardly of said blank, said flanges being spaced in longitudinal succession from one another, said longitudinal edge of said blank and said flanges extending therefrom forming a base of said housing for nesting on the upper open end of a chimney, said flanges each being bent into two integral flange portions of substantially the same transverse dimension, one of said integral flange portions of each of said flanges which is most proximate to said longitudinal edge of said blank being bent back over and beyond said longitudinal edge and extending parallel to the plane of said blank, the other one of said integral flange portions of each of said flanges being bent to extend perpendicular to the plane of said blank.

2. A chimney cap as claimed in claim 1, wherein said four sides of said housing are arranged such that each side has an opposing side of identical dimensions.

3. A chimney cap as claimed in claim 2, wherein said four flanges of said base of said housing are arranged such that each flange has an opposing flange of identical dimensions.

4. A chimney cap as claimed in claim 3, wherein said four sides of said housing are arranged in perpendicular succession with one another, and the two extreme transverse edge ends of said blank are in substantial abutment with one another.

5. A chimney cap as claimed in claim 4, including means for releasably constraining said flanges to an upon the exterior of a chimney flue whereby said perpendicularly oriented one of said integral flange portions of each of said flanges overlies and rests upon the chimney flue, and said parallel oriented one of said integral flange portions of each of said flanges forms cooperately with the other said parallel oriented ones of said integral flange portions a loop surrounding the chimney flue.

6. A chimney cap as claimed in claim 5, wherein said housing further includes a roof affixed to said sides.

7. A chimney cap as claimed in claim 6, wherein said sides are each provided with a substantially identical array of perforations.

* * * * *